US006273118B1

(12) United States Patent
Watson

(10) Patent No.: US 6,273,118 B1
(45) Date of Patent: Aug. 14, 2001

(54) TRIANGULAR DRAW AND RETURN TUBE ASSEMBLY AND METHOD OF MANUFACTURING THE SAME

(76) Inventor: Kenneth A. Watson, 1100 NE. 126th St., Vancouver, WA (US) 98685

( * ) Notice: Subject to any disclaimer, the term of this patent is extended or adjusted under 35 U.S.C. 154(b) by 0 days.

(21) Appl. No.: 09/602,675

(22) Filed: Jun. 26, 2000

Related U.S. Application Data

(63) Continuation-in-part of application No. 09/419,222, filed on Oct. 15, 1999, and a continuation-in-part of application No. 09/419,225, filed on Oct. 15, 1999, now Pat. No. 6,161,562.

(51) Int. Cl.[7] ..... F02B 55/02

(52) U.S. Cl. ..... 137/15.08; 137/351; 137/590; 137/592; 123/469

(58) Field of Search ..... 137/15.08, 351, 137/588, 590, 592, 343; 123/468, 469, 509, 514

(56) References Cited

U.S. PATENT DOCUMENTS

| | | | | |
|---|---|---|---|---|
| 2,125,674 | * | 8/1938 | Gould | 137/590 |
| 2,870,786 | * | 1/1959 | Schroeder | 137/590 |
| 3,500,858 | * | 3/1970 | Metcalf | 137/590 |
| 4,212,318 | | 7/1980 | Warmbold . | |
| 4,694,857 | | 9/1987 | Harris . | |
| 4,763,633 | * | 8/1988 | Nakanishi | 123/514 |
| 5,056,489 | * | 10/1991 | Lorraine | 123/468 |
| 5,056,492 | * | 10/1991 | Banse | 123/509 |
| 5,146,901 | | 9/1992 | Jones . | |
| 5,201,298 | * | 4/1993 | Shearn | 123/514 |
| 5,533,486 | | 7/1996 | Qutub . | |
| 5,601,066 | | 2/1997 | Qutub . | |
| 6,102,011 | * | 8/2000 | Meyer et al. | 123/509 |

* cited by examiner

*Primary Examiner*—John Rivell
(74) *Attorney, Agent, or Firm*—Ingrid McTaggart

(57) ABSTRACT

A draw and return tube assembly, and a process of manufacturing the same, provides a unitized triangular shaped assembly, wherein the draw and the return tubes are each secured to a flange and are secured to one another by a weld at a position opposite the flange. The triangular shape allows the assembly to withstand large external forces without undergoing deformation.

16 Claims, 4 Drawing Sheets

TRIANGULAR DRAW AND RETURN TUBE ASSEMBLY AND METHOD OF MANUFACTURING THE SAME

This application is a continuation-in-part of U.S. patent application Ser. No. 09/419,222, entitled DRAW AND RETURN TUBE ASSEMBLY, filed on Oct. 15, 1999, and a continuation-in-part of U.S. patent application Ser. No. 09/419,225, entitled DRAW AND RETURN TUBE ASSEMBLY AND METHOD OF MANUFACTURING THE SAME, filed on Oct. 15, 1999 now U.S. Pat. No. 6,161,562.

TECHNICAL FIELD

The present invention relates to a triangular shaped fuel draw and return tube assembly for use in commercial vehicles, and more particularly, to a triangular shaped draw and return tube assembly for use in commercial vehicles wherein the draw tube, the return tube and the flange together form a triangular shape having improved strength properties and ease of assembly.

BACKGROUND OF THE INVENTION

The present invention is particularly intended for use on commercial vehicles, although it may be used on any internal combustion engine connected to multiple fuel tanks. In particular, diesel engines typically operate by drawing fuel from a fuel tank, combusting a portion of the fuel and then returning the unused, or uncombusted, fuel to the fuel tank. Depending on engine loading conditions, a substantial volume of fuel drawn from the tank is unused by the engine and returned to the fuel tank. Accordingly, such draw and return assemblies play a vital role in the operation of diesel engines.

Heavy duty commercial vehicles, such as long haul tractor trailers, typically include dual fuel tanks, also called saddle tanks, wherein fuel is drawn simultaneously from both tanks for combustion within the engine. To prevent uneven fuel tank levels, which may lead to air being drawn into the engine, a means of balancing return fuel flow, such as draw and bottom return tube assemblies, typically are installed in each of the dual fuel tanks. One prior art draw and return tube assembly comprises draw and return tubes connected to a flange at one end and connected by a bracket at another end opposite the flange. The tubes extend outwardly from the flange parallel to one another. The flange is mounted on an upper inside surface of the fuel tank such that the opposite, bracketed ends of the tubes extend downwardly into the fuel held within the lower portion of the tank. Draw and return lines are connected to the flange, and thereby are connected to the draw and return tubes.

The tube openings opposite the flange extend away from one another and are each positioned an equal distance from the flange so that the draw and return tube fuel openings are also each positioned an equal distance below the top surface of fuel held within the tank. In this arrangement, when the two tanks and the corresponding draw and return tube assemblies are each positioned at a similar horizontal level on the commercial vehicle, the pressure head of fuel positioned above the draw and return tube openings of each assembly will result in equal amounts of fuel being withdraw from each of the tanks and equal amounts of fuel being returned to each of the tanks. In addition, swedging or crimping of the end of the return tube opening opposite the flange will facilitate complete filling of the return tube. Accordingly, the draw and return tube assemblies of the prior art act as passive flow regulators for ensuring equal levels of fuel drawn and returned to each of the two saddle fuel tanks.

The bracket used to connect the parallel draw and return tubes of the prior art generally comprises front and rear curved plates which are not welded to the tubes but which capture the tubes between the plates. The two plates are connected to one another between the tubes by a nut and bolt. A disadvantage of the bracket is that it may become loose during normal driving conditions due to vibration of the fuel tanks on the truck. Once the bracket becomes loose it may damage the inside of the fuel tank or may produce an annoying rattling sound during operation of the vehicle. The loose bracket can only be fixed by cutting a hole in the fuel tank to access the bracket because the fuel tanks are welded closed once the draw and return tube assembly is installed. Another disadvantage is that the bracket is time consuming to install and requires the manufacture of additional parts such as the metal bracket sections and the nut/bolt, a rivet, or other such fastener. Additionally, when the bracket is installed so as to connect the draw and return tubes opposite the flange, the rectangular structure that is formed is relatively weak and may bend or deform under external loading conditions. For example, when the assembly is inserted into the fuel tank during installation, the tubes may become twisted with respect to each other and/or the flange, such that the flange is deformed and cannot easily be welded to the fuel tank. Vibration of the fuel tanks during normal driving conditions may also result in twisting of the tubes with respect to each other and/or the flange. There is a need, therefore, for a draw and return tube assembly having a rigid structure which can withstand the external forces on the assembly associated with installation and normal driving conditions. Moreover, there is a need for a draw and return tube assembly wherein the tubes can be quickly and easily secured together without a bracket.

SUMMARY OF THE INVENTION

The present invention provides an improved draw and return tube assembly, and a process for manufacturing the same, that overcomes the disadvantages of the prior art. One aspect of the present invention provides a draw and return tube assembly that has a triangular shape so that the assembly can withstand large external forces without deforming. Another aspect of the present invention provides a method for manufacturing a draw and return tube assembly that allows securing the tubes together opposite the flange without the use of a bracket.

These features are provided generally in a triangular shaped draw and return tube assembly having a flange, draw and return tubes extending therefore, wherein the draw and return tubes are directly secured together opposite the flange by a weld, and wherein the tubes are angled with respect to each other such that the assembly has a strong triangular or "unitized" shape. The inventive process comprises the steps of welding the tubes to the flange such that the tubes create a triangular shape with respect to the flange, and welding the tubes together opposite the flange so that tubes are secured together without requiring additional pieces such as a bracket. Accordingly, the assembly and method of manufacturing the assembly provides a simple, low cost method for manufacturing a strong draw and return tube assembly that can withstand the rigors of assembly and use without deformation.

DETAILED DESCRIPTION OF THE PREFERRED EMBODIMENTS

As has been mentioned, the invention provides a draw and return tube assembly that is intended for use on commercial vehicles, although it may be used with any internal combustion engine connected to a fuel tank requiring a draw and return tube assembly.

Figure 1:
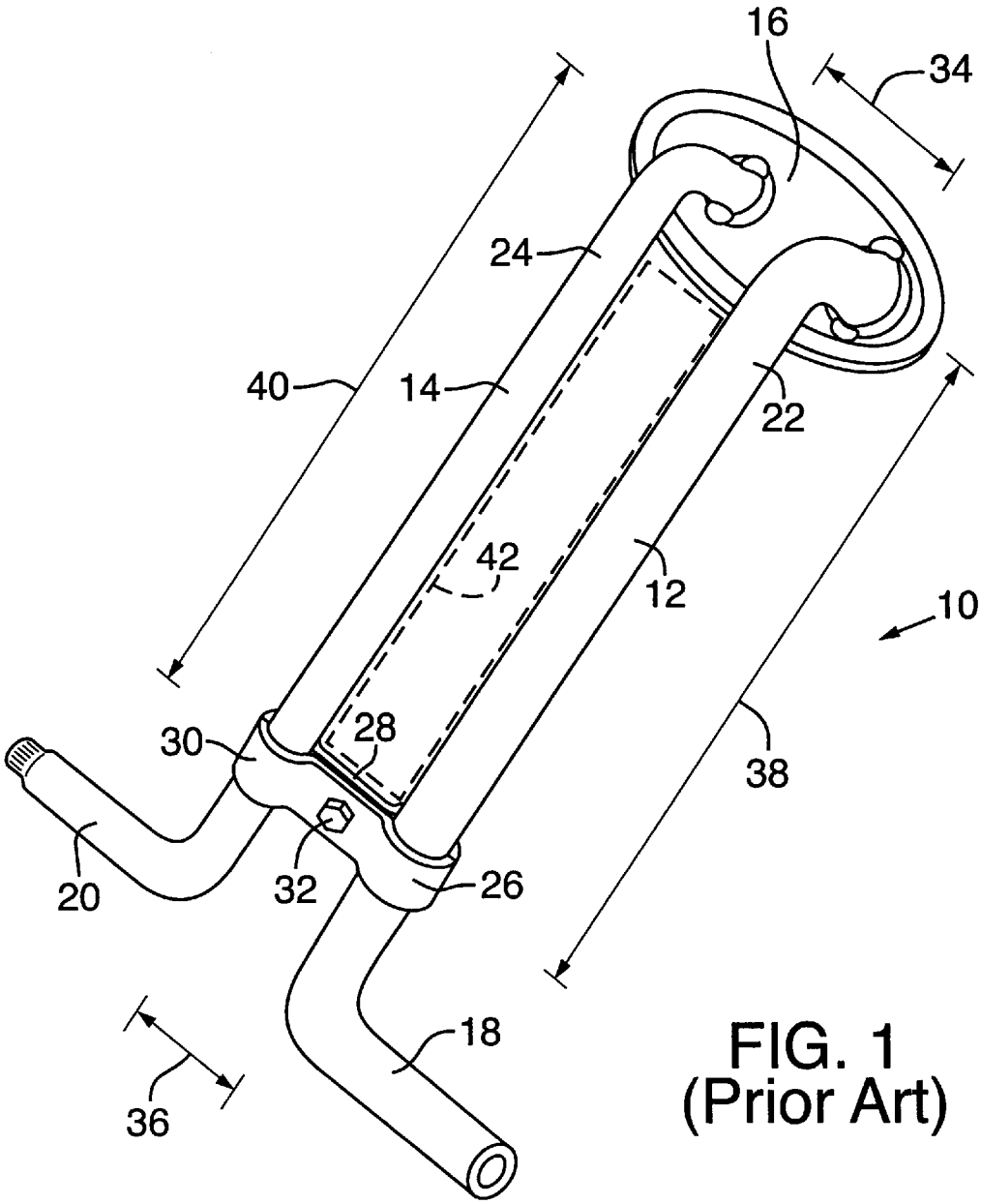
FIG. 1 (Prior Art)
FIG. 1 is an isometric view of a draw and return tube assembly of the prior art.

FIG. 1 shows a draw and return tube assembly 10 of the prior art including a draw tube 12, a return tube 14, and a flange 16, also called a base or a baseplate, to which the tubes are welded. Each of the tubes has a first end 18 and 20, respectively, positioned opposite the flange and a second end 22 and 24, respectively, welded to the flange at corresponding apertures (not shown), also called connection ports or regions. (Either end of the tubes may be called the first or the second end.) A bracket 26 secures ends 18 and 20 of the tubes together, opposite the flange. The bracket includes a first plate 28, a second plate 30, and a fastener 32 such as a standard nut and bolt. Each plate includes curved regions which surround approximately half of the diameter of the tubes such that when the plates are secured together by fastener 32, the plates are frictionally secured to the tubes. Accordingly, the bracket is not welded to the tubes and the tubes are free to rotate within the bracket when subjected to certain external loads.

End regions 22 and 24 of tubes 12 and 14 typically are spaced from one another at flange 16 by a distance 34. End regions 18 and 20 of the tubes typically are spaced from one another at bracket 32 by a distance 36. Distance 34 typically is the same as distance 36. Lengths 38 and 40, respectively, of tubes 12 and 14 from flange 16 to bracket 32 typically are the same such that assembly 10 comprises a rectangular structure represented by the dash lines 42. This rectangular structure is relatively weak and is susceptible to external forces, such as a torque, which may bend or otherwise deform the assembly. In particular, when the assembly is inserted into a fuel tank during installation, the tubes may become twisted with respect to each other and the flange, such that the flange is deformed and cannot easily be welded to the fuel tank. Vibration of the fuel tanks during normal driving conditions may also result in twisting of the tubes with respect to each other and the flange. This movement of the tubes with respect to each other may result in incorrect positioning of the tubes within the fuel tank thereby interfering with proper draw and return of fuel. Moreover, the installation of the bracket on the draw and return tubes is time consuming and requires the purchase or manufacture of the bracket components, namely, the two bracket sections and the fastener. The weakness of the rectangular structure is further increased if the bracket becomes loose on the tubes during use.

Figure 2:
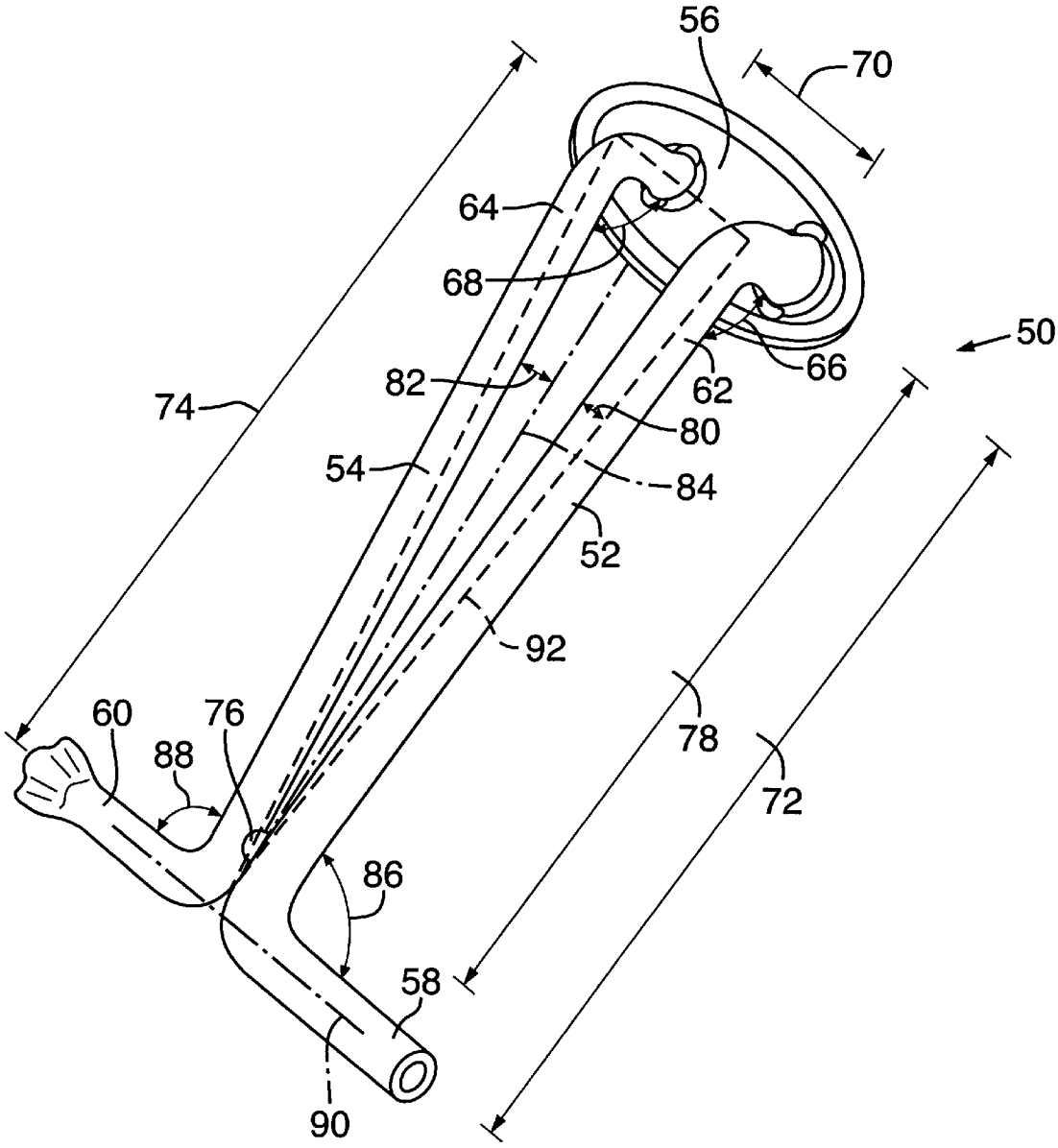
FIG. 2 is an isometric view of the draw and return tube assembly of the present invention.

FIG. 2 shows the draw and return tube assembly 50 of the present invention including a draw tube 52, a return tube 54, and a flange 56, also called a base or a base plate, to which the tubes are welded. Each of the tubes has a first end 58 and 60, respectively, positioned opposite the flange and a second end 62 and 64, respectively, welded to the flange at the flange apertures (not shown), also called connection ports or regions. Tubes 52 and 54 both extend outwardly from flange 56 at angles 66 and 68, respectively, of approximately one hundred and twenty degrees. The angle typically ranges between one hundred and one hundred and forty degrees. The tubes are spaced apart at the flange a distance 70 of approximately four inches, and typically in a range of two to six inches. The tubes each have a length 72 and 74, respectively, of approximately twenty inches measured from the flange to the bend in the first end region of the tubes. The length typically ranges from fifteen to twenty fives inches. Those skilled in the art will understand that the dimensions cited herein are of a single embodiment but that the assembly may be manufactured in any size as is appropriate. In particular, the flange may be welded to the top or the side of a fuel tank such that the location of the flange on the tank, and the size of the tank, will determine the appropriate length of diameter of the tubes used.

Tubes 52 and 54 are connected to one another at a weld 76 positioned a distance 78 from flange 56. In the embodiment shown, distance 78 is approximately seventeen inches. Tubes 52 and 54 may be manufactured of any desirable material such as metal or plastic, and typically are manufactured of steel or aluminum. Weld 76 may comprise a fillet weld, a spot weld, or any other type of weld or other direct connection as will function to secure the tubes together. In the embodiment shown, tubes 52 and 54 are positioned at angles 80 and 82 with respect to an elongate axis 84 of the assembly, wherein axis 84 extends from weld 76 though the flange between ends 62 and 64 of the tubes. Angles 80 and 82, in the embodiment shown, are each approximately seven degrees, and preferably between five and ten degrees. In other embodiments, angles 80 and 82 may not be equal to one another and may each be anywhere in a range of approximately one to eighty nine degrees. Ends 58 and 60 of the tubes, respectively, extend away from each other and from the length of the tubes at angles 86 and 88, respectively, of approximately eighty three degrees. The angle may be of any value and typically is chosen so that the open ends of the two tubes extend directly opposite from one another. Accordingly, each of ends 58 and 60 are positioned along a transverse axis 90 of the assembly.

The angle of the tubes with respect to each other defines a triangular, or a "unitized", structure represented by the dash lines 92. This triangular structure can also be described as a triangular structure, an "A-frame" shape, a weight bearing triangular shape, or a load bearing triangular structure. This triangular or "unitized" structure renders the assembly exceptionally strong and resistant to bending, twisting, and other such type deformation of the assembly. Accordingly, the assembly is not easily damaged during installation of the assembly in a fuel tank or during operation of the device. Additionally, use of weld 76 to secure the tubes together is a stronger, cheaper and more easily installed connection than the bracket of the prior art. Moreover, the weld will typically not become loose or deposit contaminate pieces of a bracket into the fuel tank which may damage the tank or create an annoying rattling sound during operation of the vehicle.

Figure 3:
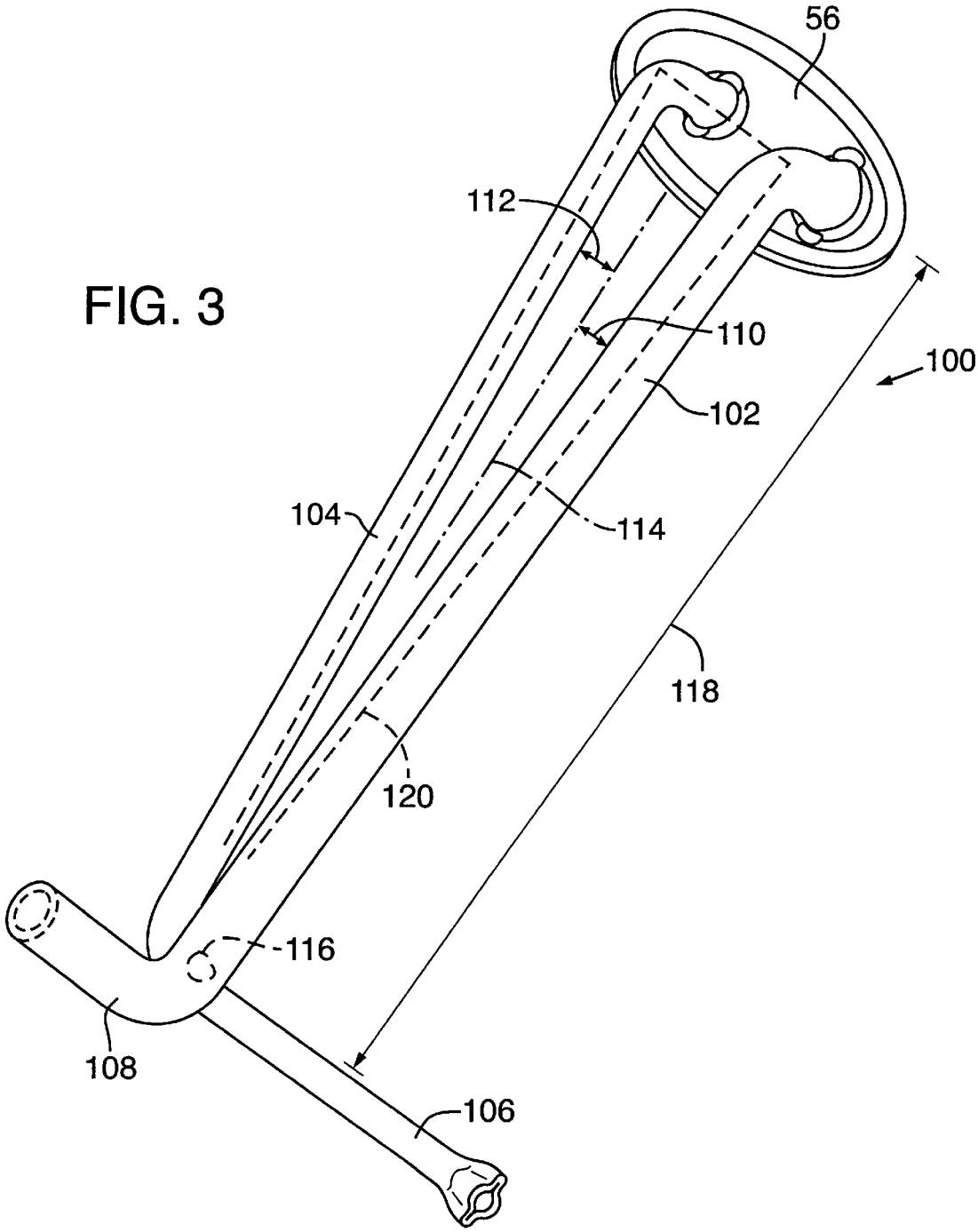
FIG. 3 is an isometric view of another embodiment of the draw and return tube assembly of the present invention

FIG. 3 shows an isometric view of another embodiment of the draw and return tube assembly of the present invention. Assembly 100 includes tubes 102 and 104 wherein the tubes are crossed in end regions 106 and 108. The tubes are positioned at angles 110 and 112, respectively, with respect to an elongate axis 114 of the assembly and are welded together at a weld 116 positioned a distance 118 from flange 56. In the embodiment shown, angle 110 is approximately five degrees, angle 112 is approximately nine degrees, and elongate axis 114 extends through weld 116 and perpendicular to flange 56 at a position slightly closer to tube 102 than to tube 104. This creates a strong triangular structure represented by dash lines 120, however, the triangular structure is not a perfect isosceles triangle.

Figure 4:
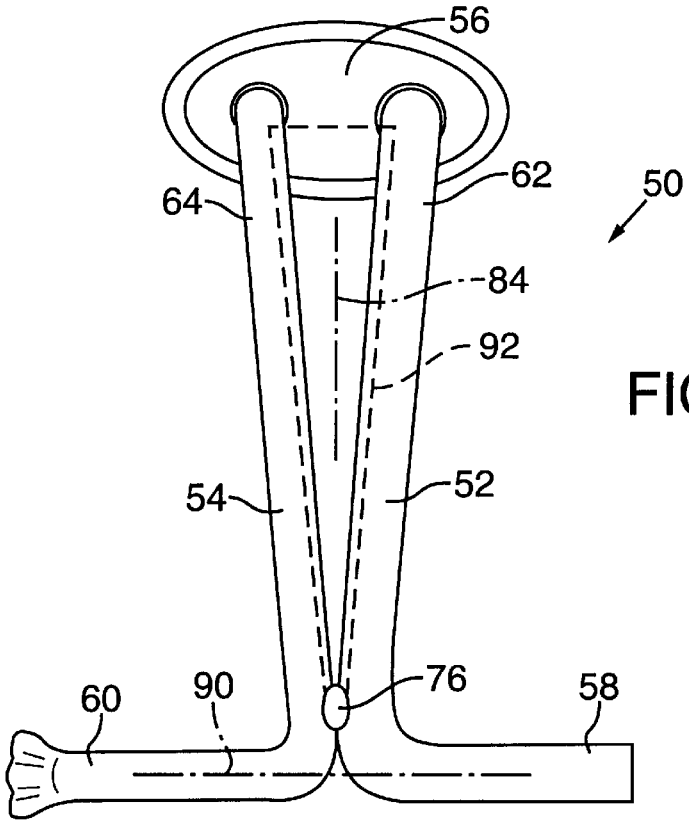
FIG. 4 is a front view of the draw and return tube assembly of FIG. 2.

FIG. 4 shows a front view of draw and return tube assembly 50 of FIG. 2. Weld 76 is shown positioned between tubes 52 and 54 where the tubes meet one another. Triangular structure 92 is shown extending from weld 76 upwardly through the tubes and through the flange perpendicularly to elongate axis 84.

Figure 5:
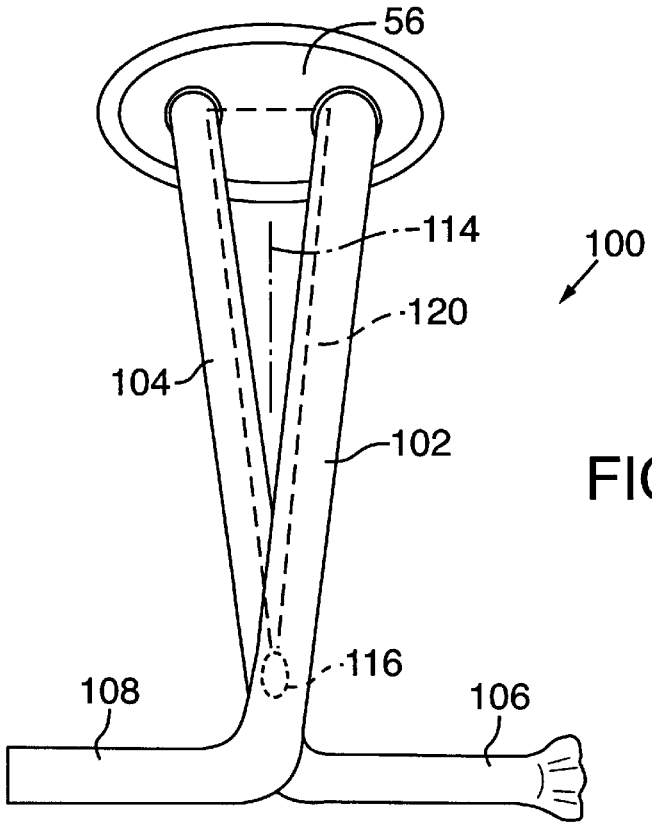
FIG. 5 is a front view of the draw and return tube assembly of FIG. 3.

FIG. 5 shows a front view of draw and return tube assembly 100 of FIG. 3. Weld 116 is shown positioned between tubes 102 and 104 where the tubes meet one another. In particular, tube 102 is in front of weld 116 which is in front of tube 104, in the view shown, so that the weld is shown in dash lines. Triangular structure 120 is shown extending from weld 116 upwardly through the tubes and through the flange.

The process of manufacturing the draw and return tube assembly of the present invention will now be described. Tubes 52 and 54 are first extruded or flared to have the appropriate inner and outer diameters. Typically, the inner and outer diameter of the tubing chosen is dependent on the size of the flange and the connections of the flange to the draw and return fuel lines (not shown). The tubes may also be flared if desired. Once the tubing has been extruded with the desired inner and outer diameter, the tubes are cut to the correct length.

Next, the tubes are bent at their second ends, 62 and 64, to create the one hundred and twenty degree angle of the tubes which extend from flange 56. The tubes are then bent a second time to define end regions 58 and 60. In the embodiment shown in FIG. 2, the tubes are bent at an angle of approximately eighty three degrees in end regions 58 and 60, respectively. Second ends 62 and 64 of the tubes are then welded or otherwise attached to the flange. In the embodiment shown, flange 56 includes only two apertures, each positioned to receive a draw and a return tube, respectively. In other embodiments the flange may be shaped or sized so as to include additional apertures for other purposes such as vents and the like. The tubes are then secured together by weld 76 to stabilize the device in the unitized triangular shape. The weld may be a fillet weld, a spot weld or any other type of direct connection. In the preferred embodiment the tubes are manufactured of aluminum, due to its low cost and ease of availability, and the weld is also an aluminum material.

Once the tubes have been secured to the flange and welded to each other, the inner diameter of the tubes adjacent the flange are tapped to create threads having the same gauge as the threads of draw and return line connectors (not shown). The first end of one or both of the tubes may then be swedged or crimped.

The process of welding the tubes together at their ends opposite the flange is typically a much faster process than securing the tubes with a bracket as in the process of the prior art. The weld step may take only several seconds to accomplish whereas in the prior art the multiple bracket pieces must be aligned and secured together with a small fastener which may be difficult to handle and align. Moreover, the weld material utilized in the present invention is typically much cheaper than the cost of the bracket of the prior art. Accordingly, the inventive process is less expensive and less time consuming than the prior art process utilizing a bracket.

In the above description numerous details have been set forth in order to provide a more through understanding of the present invention. It will be obvious, however, to one skilled in the art that the present invention may be practiced using other equivalent designs.

What is claimed is:

1. A draw and return tube fuel assembly for use in commercial vehicles, comprising:

a flange having first and second apertures extending therethrough and being spaced a distance apart;

a return tube having a first end region secured to said flange at said first aperture and a second end region positioned opposite said first end region of the return tube; and a draw tube having a first end region secured to said flange at said second aperture and a second end region positioned opposite said first end region of the draw tube, wherein said second end region of said return tube is secured to said second end region of said draw tube such that said assembly defines a triangular structure.

2. The draw and return tube fuel assembly of claim 1 wherein said second end region of said return tube is secured to said second end region of said draw tube by a weld and wherein the return tube, the draw tube and the weld are manufactured of aluminum.

3. The draw and return tube assembly of claim 1 wherein said assembly includes an elongate axis and wherein a length of said draw tube defines an angle with respect to said elongate axis in a range from one to eighty nine degrees, and wherein a length of said return tube defines an angle with respect to said elongate axis in a range from one to eighty nine degrees.

4. The draw and return tube fuel assembly of claim 1 wherein the draw tube and the return tube extend away from one another in their second end regions.

5. The draw and return tube fuel assembly of claim 1 wherein the draw tube and the return tube cross over one another in their second end regions.

6. The draw and return tube fuel assembly of claim 3 wherein the angle said draw tube defines with respect to said elongate axis is in a range from five to ten degrees, and wherein the angle said return tube defines with respect to said elongate axis is in a range from five to ten degrees.

7. The draw and return tube fuel assembly of claim 1 wherein said first and second apertures of said flange are spaced apart approximately four inches, said draw tube has a length of between fifteen and twenty two inches measured from said flange to said weld, and said return tube has a length of between fifteen and twenty two inches measured from said flange to said weld.

8. A process of manufacturing a draw and return tube fuel assembly for use in commercial vehicles, comprising the steps of:

providing a return tube having a first end region and a second end region positioned opposite said first end region;

providing a draw tube having a first end region and a second end region positioned opposite said first end region;

providing a flange having first and second connection regions therein;

securing the first end region of the return tube to the flange at the first first connection region;

securing the first end region of the draw tube to the flange at the second connection region; and securing the second end region of the return tube to the second end region of the draw tube to define a triangular structure.

9. The process of claim 8 further comprising the step of bending said first end region of said return tube to define an angle within a range of one hundred to one hundred and forty degrees, and further comprising the step of bending said first end region of said draw tube to define an angle within a range of one hundred to one hundred and forty degrees.

10. The process of claim 8 wherein the step of securing said first end region of the return tube to the flange comprises securing said return tube such that a length of said return tube defines an angle with respect to an elongate axis of said assembly in a range of five to ten degrees, and wherein the step of securing said first end region of the draw tube to the flange comprises securing said draw tube such that a length of said draw tube defines an angle with respect to the elongate axis of said assembly in a range of five to ten degrees.

11. The process of claim 8 further comprising the step of bending said second end region of said return tube to define an angle within a range of seventy five to ninety five degrees, and further comprising the step of bending said second end region of said draw tube to define an angle within a range of seventy five to ninety five degrees.

12. The process of claim 8 wherein the step of securing said first end region of the return tube to the flange and the step of securing said first end region of the draw tube to the flange comprises securing said draw tube and said return tube to the flange such that the tubes cross over one another in said second end regions.

13. The process of claim 8 wherein the step of securing the second end region of the return tube to the second end region of the draw tube comprises welding the return tube to the draw tube.

14. A fuel tank assembly comprising:

a fuel tank;

a draw and return assembly positioned within said fuel tank and including:

a return tube having a first end region operatively connected to said fuel tank and a second end region positioned opposite said first end region of the return tube; and a draw tube having a first end region operatively connected to said fuel tank and spaced a distance from said first end region of said return tube, and a second end region positioned opposite said first end region of the draw tube, wherein said second end region of said return tube is secured to said second end region of said draw tube such that a portion of said fuel tank, said return tube and said draw tube define a triangular structure.

15. The assembly of claim 14 further comprising a base wherein said first end region of said draw tube is secured to said base, said first end region of said return tube is secured to said base, and said base is secured to said fuel tank.

16. The assembly of claim 14 wherein said second end region of said return tube is directly welded to said second end region of said draw tube.

* * * * *